US007319293B2

(12) United States Patent
Maxik

(10) Patent No.: US 7,319,293 B2
(45) Date of Patent: Jan. 15, 2008

(54) LIGHT BULB HAVING WIDE ANGLE LIGHT DISPERSION USING CRYSTALLINE MATERIAL

(75) Inventor: Fredric Maxik, Plantation, FL (US)

(73) Assignee: Lighting Science Group Corporation, Dallas, TX (US)

( * ) Notice: Subject to any disclaimer, the term of this patent is extended or adjusted under 35 U.S.C. 154(b) by 31 days.

(21) Appl. No.: 10/915,301

(22) Filed: Aug. 9, 2004

(65) Prior Publication Data

US 2005/0242734 A1 Nov. 3, 2005

Related U.S. Application Data

(60) Provisional application No. 60/567,082, filed on Apr. 30, 2004.

(51) Int. Cl.
*H01J 17/16* (2006.01)

(52) U.S. Cl. ..... 313/636; 313/634

(58) Field of Classification Search ..... 313/110, 313/112, 634–636

See application file for complete search history.

(56) References Cited

U.S. PATENT DOCUMENTS

| | | | |
|---|---|---|---|
| 2,981,827 | A | 4/1961 | Orsatti et al. |
| 4,136,378 | A | 1/1979 | Chevali |
| 4,211,955 | A | 7/1980 | Ray |
| 4,243,934 | A | 1/1981 | Brasfield |
| 4,423,473 | A | 12/1983 | Kirkley |
| 4,455,562 | A | 6/1984 | Dolan et al. |
| D302,863 | S | 8/1989 | Krol |
| D325,994 | S | 5/1992 | Hume et al. |
| 5,136,483 | A | 8/1992 | Schoniger |
| 5,162,696 | A | 11/1992 | Goodrich |
| 5,175,528 | A | 12/1992 | Choi et al. |
| D336,963 | S | 6/1993 | Levin et al. |
| 5,313,187 | A | 5/1994 | Choi et al. |

(Continued)

FOREIGN PATENT DOCUMENTS

DE 101 05 622 A1 8/2002

(Continued)

OTHER PUBLICATIONS

Fredric S. Maxik and Addy S. Widjaja, U.S. Appl. No. 29/235,139, filed Jul. 27, 2005 for "LED Light Bulb".

(Continued)

*Primary Examiner*—Joseph Williams
*Assistant Examiner*—Bumsuk Won
(74) *Attorney, Agent, or Firm*—Haynes and Boone, LLP

(57) ABSTRACT

The present light bulb includes a wide angle dispersed light which uses, as a source of light dispersion, crystalline particulate material incorporated into the molded or formed material of the light bulb. The crystalline particulate material can be incorporated into the light bulb material prior to the molding or forming process or it can be later applied to the surfaces of the light bulb. The crystalline particulate material are chosen to provide high reflectivity and dispersion qualities for the parts of the light bulb and are further chosen and incorporated according to the function of the particular piece or part therein incorporated. A light tuning element may also be used to further enhance the light dispersion qualities of the light bulb. Methods for making the present light bulb are also provided.

13 Claims, 4 Drawing Sheets

U.S. PATENT DOCUMENTS 5,358,880 A 10/1994 Lebby
D355,495 S 2/1995 Matsumura et al.
5,439,941 A 8/1995 Butler et al.
5,561,346 A 10/1996 Byrne
5,585,783 A 12/1996 Hall
5,707,132 A 1/1998 Ooki et al.
5,749,646 A 5/1998 Brittell
D395,092 S 6/1998 Vakil
5,782,553 A 7/1998 McDermott
5,877,863 A 3/1999 Ross et al.
5,929,788 A * 7/1999 Vukosic ..... 340/908.1
D414,282 S 9/1999 Kato et al.
6,016,038 A 1/2000 Mueller et al.
D426,653 S 6/2000 Ho
D427,335 S 6/2000 Noll
D433,166 S 10/2000 Noll
6,150,771 A 11/2000 Perry
6,150,774 A 11/2000 Mueller
D435,577 S 12/2000 McBride
6,166,496 A 12/2000 Lys
6,184,628 B1 2/2001 Ruthenberg
6,211,626 B1 4/2001 Lys
6,220,722 B1 4/2001 Begemann
6,227,679 B1 5/2001 Zhang
6,285,119 B1 9/2001 Sundhar
6,286,969 B1 9/2001 Kurokawa et al.
6,293,684 B1 9/2001 Riblett
6,345,903 B1 2/2002 Koike
6,350,041 B1 2/2002 Tarsa et al.
6,369,781 B2 4/2002 Hashimoto et al.
6,371,636 B1 4/2002 Wesson
6,489,937 B1 12/2002 Ruvinsky
D469,890 S 2/2003 Bobel
D470,606 S 2/2003 Bobel
D470,608 S 2/2003 Bobel
D470,610 S 2/2003 Bobel
6,523,978 B1 2/2003 Huang
6,547,421 B2 4/2003 Sugano
6,548,967 B1 4/2003 Dowling
6,580,228 B1 * 6/2003 Chen et al. ..... 315/185 R
6,600,274 B1 7/2003 Hughes
6,608,453 B2 8/2003 Morgan
6,621,222 B1 9/2003 Hong
D482,143 S 11/2003 Buschmann et al.
6,659,632 B2 12/2003 Chen
6,662,489 B2 12/2003 Spiro et al.
6,674,096 B2 1/2004 Sommers
6,683,419 B2 1/2004 Kriparos
6,697,130 B2 2/2004 Weindorf
D487,940 S 3/2004 Buschmann et al.
6,707,247 B2 3/2004 Murano
6,709,126 B1 3/2004 Leen
6,709,132 B2 3/2004 Ishibashi
6,724,156 B2 4/2004 Fregoso
D490,919 S 6/2004 Wiesmeth
D491,301 S 6/2004 Chen
D493,007 S 7/2004 Rugendyke et al.
6,767,111 B1 * 7/2004 Lai ..... 362/240
D494,687 S 8/2004 Matsui et al.
D497,439 S 10/2004 Shaw et al.
D498,310 S 11/2004 Gagnon et al.
6,822,397 B2 11/2004 Kawasaki et al.
D500,872 S 1/2005 Foo
D501,055 S 1/2005 Packard
6,840,003 B2 1/2005 Moore
6,883,938 B1 4/2005 Kohara et al.
D505,738 S 5/2005 Buschmann et al.
6,900,781 B1 5/2005 Mori et al.
D508,575 S 8/2005 Buschmann et al.
D514,237 S 1/2006 Buschmann et al.
D516,229 S 2/2006 Tang
D528,227 S 9/2006 Chou et al.
D529,635 S 10/2006 Johnson
2001/0024112 A1 9/2001 Jacobs et al.
2001/0055353 A1 12/2001 Rybicki et al.
2002/0187570 A1 12/2002 Fukasawa
2003/0031015 A1 2/2003 Ishibashi
2003/0072145 A1 4/2003 Nolan et al.
2003/0090910 A1 5/2003 Chen
2003/0117803 A1 6/2003 Chen
2004/0026683 A1 2/2004 Yamada et al.
2004/0037080 A1 2/2004 Luk et al.
2004/0189185 A1 * 9/2004 Yotsuya ..... 313/501
2005/0007304 A1 1/2005 Gallagher et al.
2005/0099108 A1 5/2005 Hofmann et al.
2005/0174769 A1 8/2005 Yong et al.
2005/0248277 A1 * 11/2005 Van Bruggen et al. ..... 313/636

FOREIGN PATENT DOCUMENTS

EP 0 441 965 A1 8/1991
EP 0 617 092 A2 3/1994
EP 0 939 429 A1 9/1999
FR 2 586 844 3/1987
GB 2 345 954 A 7/2000
GB 2 366 610 A 3/2002
JP 10-305453 11/1998
JP 2000-21209 1/2000
JP 2001 243807 9/2001
JP 2001 325809 11/2001
WO WO 03/017320 A1 2/2003
WO WO 03/034458 A2 4/2003
WO WO 03/059013 A1 7/2003
WO WO 2004/003869 1/2004

OTHER PUBLICATIONS

Fredric S. Maxik and Addy S. Widjaja, U.S. Appl. No. 29/235,140, filed Jul. 27, 2005 for "LED Light Bulb".
Fredric S. Maxik, U.S. Appl. No. 29/235,514, filed Aug. 2, 2005 for "LED Light Bulb".
Fredric S. Maxik, U.S. Appl. No. 29/243,097, filed Nov. 18, 2005 for "LED Light Bulb".
Fredric S. Maxik, U.S. Appl. No. 60/554,469, filed Mar. 18, 2004 for "Lightbulb Using Electronically Activated Light Emitting Elements and Method of Making Same".
Fredric S. Maxik, U.S. Appl. No. 60/565,268, filed Apr. 23, 2004 for "Electronic Light Generating Element Lightbulb".
Fredric S. Maxik, U.S. Appl. No. 60/567,082, filed Apr. 30, 2004 for "Wide Angle Light Dispersion Electronically Activated Lightbulb and Method of Making Same".
Fredric S. Maxik, U.S. Appl. No. 60/567,226, filed Apr. 30, 2004 for "Lightbulb Using Electronic Light Generating Sources".
Fredric S. Maxik and Catherina G.M. Friderici, U.S. Appl. No. 29/224,334, filed Feb. 28, 2005 for "Flashlight".
Fredric S. Maxik and Catherina G.M. Friderici, U.S. Appl. No. 29/224,333, filed Feb. 28, 2005 for "Floodlight".
Fredric S. Maxik, U.S. Appl. No. 10/915,137 filed Aug. 9, 2004 for "System and Method for Providing Multi-Functional Lighting Using High-Efficiency Lighting Elements in an Environment".
Fredric S. Maxik, U.S. Appl. No. 10/915,138, filed Aug. 9, 2004 for "Light Bulb Having Surfaces for Reflecting Light Produced by Electronic Light Generating Sources".
Fredric S. Maxik, U.S. Appl. No. 10/915,278, filed Aug. 9, 2004 for "Lighting Element Using Electronically Activated Light Emitting Elements and Method of Making Same".
Fredric S. Maxik, U.S. Appl. No. 10/915,531, filed Aug. 9, 2004 for "Electronic Light Generating Element Light Bulb".
Fredric S. Maxik, U.S. Appl. No. 29/214,892, filed Oct. 8, 2004 for "LED Light Bulb".
Fredric S. Maxik, U.S. Appl. No. 29/214,893, filed Oct. 8, 2004 for "LED Light Bulb".
PCT Search Report (PCT/ISA/220 and 210) and Written Opinion (PCT/ISA/237) dated Sep. 6, 2006 for PCT Application No. PCT/US2005/014817, 13 pages.

Fredric S. Maxik, U.S. Appl. No. 29/254,208, filed Feb. 17, 2006 for "LED Light Bulb".
Fredric S. Maxik, Catherina G.M. Friderici, and Wei Sun, U.S. Appl. No. 29/254,209, filed Feb. 17, 2006 for "LED Light Bulb".
Fredric S. Maxik and Addy S. Widjaja, U.S. Appl. No. 29/254,210 filed Feb. 17, 2006 for "LED Light Bulb".

* cited by examiner

LIGHT BULB HAVING WIDE ANGLE LIGHT DISPERSION USING CRYSTALLINE MATERIAL

CROSS REFERENCE TO RELATED APPLICATIONS

This application is based on U.S. Provisional Application No. 60/567,082 entitled Wide Angle Light Dispersion Electronically Activated Light bulb and Method of Making Same filed on 30 Apr. 2004. The benefit of the filing date of the Provisional Application is claimed for this application. The entire contents of the Provisional Application are incorporated herein by reference.

FIELD OF THE INVENTION

The present invention relates to light bulbs. More specifically, the invention relates to light bulbs having a wide angle of light dispersion comprised of light emitting diodes (LED's).

PROBLEM

In recent years, there has been an increased interest in lamps or so-called "light bulbs" which use light emitting diodes (LED's) as the source of light. These light bulbs are quite attractive since they overcome many of the disadvantages of the conventional light sources which include, for example, incandescent light bulbs, fluorescent light bulbs, halogen light bulbs and metal halide light bulbs. However, due to their point source emission of light, LED's do not provide for a wide angle of light dispersion. Some attempts have been made to increase brightness and dispersion and improve color of present day LED's.

Individual LED's have been modified to provide a uniform color and luminance distribution by layering epoxy containing different materials such as fluorescent materials above the LED. In addition, the walls of the individual LED may be covered with a reflective material, such as silver. As the light produced from the LED's changes colors as it travels through the different layers being effected by the fluorescent materials and coloring materials deposited within the layers.

Another attempt to improve the dispersion qualities of LED's involves utilizing mirror stacks within the LED body to provide multiple reflections of light inside the LED cavity. Further, attempts have been made to improve the reflectivity of the light emitting from an individual LED by incorporating reflective surfaces within the individual LED housing. Still further, manufacturing methods are known which encase the individual LED in a transparent epoxy which is then surrounded by a reflective layer and shaped to provide individual LED's.

In addition, attempts have been made to reduce the amount of ultraviolet (UV) wavelength light from entering the individual LED casing, to thereby decrease the aging of wavelength converting material. Different layers of transparent resin material are used including a light condenser portion to prevent UV light from aging the wavelength converting material.

Based on these improvements, light emitting diodes can be ganged or grouped together in a bulb to generate a substantial amount of light. However, one of the main disadvantages of essentially all light emitting diode bulbs heretofore attempted was the fact that light emitting diodes tend to act as point sources which produce columns of light.

Hence, there is little or no dispersion of the light. Inasmuch as most people are more comfortable with a uniformly well-lighted area, as opposed to light from a point source, it would be highly desirable to provide a substantial amount of light dispersion. However, light emitting diodes, by their very nature, only generate columnar light.

Heretofore, there has not been any effective commercially available construction which allows for wide distribution of light in a light bulb constructed in such manner so as to avoid the universal point source of light. The point source of light from these various electronic light emitting elements cannot be changed due to the nature of the physical principles of operation thereof. However, there still is a need for a light bulb using electronically activated light emitting elements and which provides, in combination, a wide degree of light dispersion as well as a method of making same.

Information relevant to attempts to address these problems can be found in U.S. Pat. No. 6,707,247 issued Mar. 16, 2004 to Murano; U.S. Pat. No. 5,358,880 issued Oct. 25, 1994 to Lebby et al.; U.S. Pat. No. 6,345,903 issued Feb. 12, 2002 to Koike; and published U.S. Pat. Application No. US2002/0187570 filed Jun. 12, 2002 by Fukasawa et al. However, each one of these references suffers from one or more of the following disadvantages: lack of functionality and limited light dispersion properties.

SOLUTION

The present light bulb overcomes these disadvantages in a unique light bulb providing a wide angle of light dispersion as well as an associated method of making the light bulbs. The present light bulb relates in general terms to both a light bulb and a method of making same which uses a granular material incorporated into the resin material used to form the light bulb housing.

The light bulb of the present invention is characterized by the fact that a particulate material such as, for example, ground quartz or diamond dust or the like could be incorporated in the material, such as a resin, used in formation of the side wall of the housing and, possibly, for the lens as well. After light emitting diodes or other light generating elements have been mounted in a support plate or, for that matter, on a printed circuit board, and connected to a base, the side wall of the housing can be formed by molding to a desired shape. In this case, the housing side wall will typically adopt somewhat of a conical shape, although any shape could be employed. The lens or end cap of the housing is preferably either flat or slightly hemispherical.

Preferably, before the housing side wall is cast into a desired shape, a desired amount of particulate material is mixed with the resin material prior to being introduced into the mold. As indicated, any suitable resin can be used in the formation of the side wall or the end cap of the housing. The amount of particulate material will vary depending upon the desired amount of light dispersion. Obviously, there is a maximum amount of particulate material which can be added, since an excess of such material could tend to cause some opaqueness. It is preferable to use between 1% to about 12% by weight of particulate material with respect to the resin. However, again this amount could vary depending upon the results which are desired.

It is preferable to control the orientation of the particulate material added. At least 60% of the particulate material should be essentially oriented in the same direction.

It is also possible to perform color blending in the resin-particulate mix. Color can be adjusted by adding a dye only in small amounts so as to avoid interference with the transparency of the material. As a simple example, it is possible to even simulate daylight, such as sunlight, by introducing a small amount of a yellow dye into the resin-particulate mixture.

This present light bulb thereby provides a unique and novel wide angle light dispersion electronically activated light bulb and method of making same, which will become more fully apparent from a consideration of the forms in which it may be embodied. The present light bulb includes light bulbs being made of a material that has crystalline particulate material incorporated into the surfaces of the light bulb for providing dispersion of light. Further, the crystalline particulate material may be added to a mixture prior to molding or after and incorporated with adhesives or the like to the part or piece of a light bulb and then later assembled. Further still, methods are provided for making a light bulb providing a widely dispersed light. Forms of these light bulbs are more fully illustrated in the accompanying drawings and described in the following detailed description of the invention. However, it should be understood that the accompanying drawings and this detailed description are set forth only for purposes of illustrating the general principles of the invention.

These and other features, aspects, and advantages of the present light bulb will become better understood with regard to the following description, appended claims, and accompanying drawings.

DETAILED DESCRIPTION OF THE DRAWINGS

Figure 1:
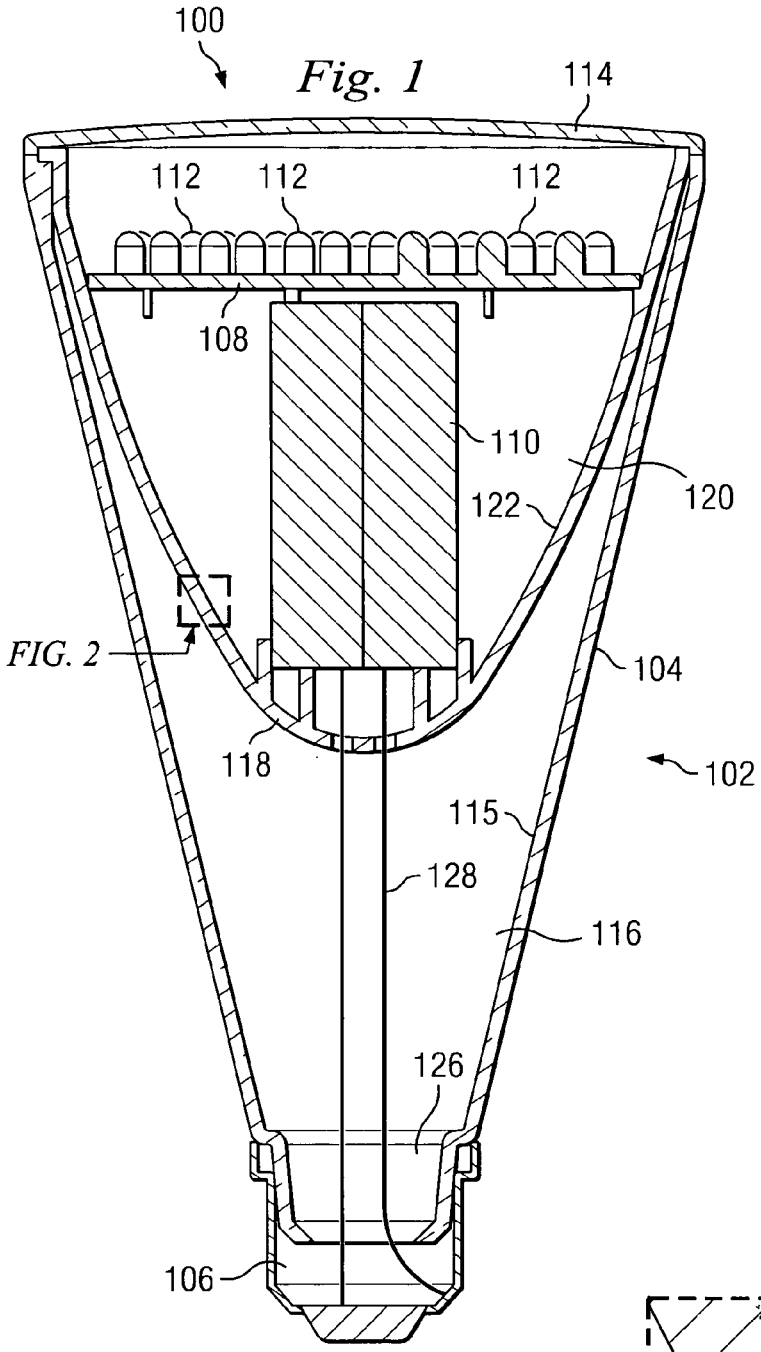
FIG. 1 illustrates a cross-section view of a light bulb having wide angle dispersion material incorporated therein in accordance with the invention.

Referring now in more detail and by reference to FIG. 1, there is provided an embodiment of a light bulb 100 having a wide angle of light dispersion including a housing 102 having a somewhat conically shaped side wall 104 having an inside surface 115 and which is provided at one end with a base 106 such as a conventional Edison base and which is provided at the other end with a transparent or translucent end cap 114. A cavity 116 is defined by the area between the side wall 104 and the transparent or translucent end cap 114. Mounted within the cavity 116 of the housing 102 is a support 110 for supporting a substrate 108 having a plurality of light emitting elements 112. The entire support 110 and light emitting elements 112 are covered partially or fully by the end cap 114. In the embodiment as shown, it should be understood that it is possible to eliminate the end cap 114 and use the substrate 108 as the end cap for the housing.

In this embodiment, a semi-hemispherical shaped insert 118 having an inside surface 122 is inserted into the housing 102 to provide a base for the support 110 and a surface for reflecting light that enters the cavity 116 of the insert 118. An insert cavity 120 is defined by the area between the insert 118 and the translucent end cap 114.

Figure 2:
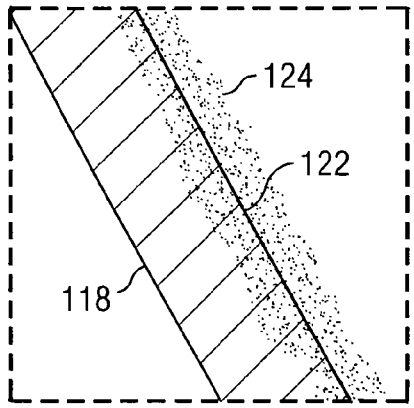
FIG. 2 illustrates an expanded cross-section of a side wall and incorporated crystalline particulate material of a light bulb in accordance with the invention.

Referring to FIG. 2 is an expanded view of a portion of the insert 118 depicting the crystalline particulate material according to the present light bulb. As can be seen from FIG. 2, the crystalline particulate material 124 is incorporated on the inside surface 122 of the insert 118 and also within the material comprising the insert. In one aspect of the present light bulb, the crystalline particulate material 124 can be mixed and formed with the housing 102, substrate side wall 104, inside surface 115, end cap 114, substrate 108, and support 110. In another aspect of the present light bulb, the crystalline particulate material 124 can be applied with adhesives or the like to the surfaces of the light bulbs after they have been formed or assembled.

Figure 3:
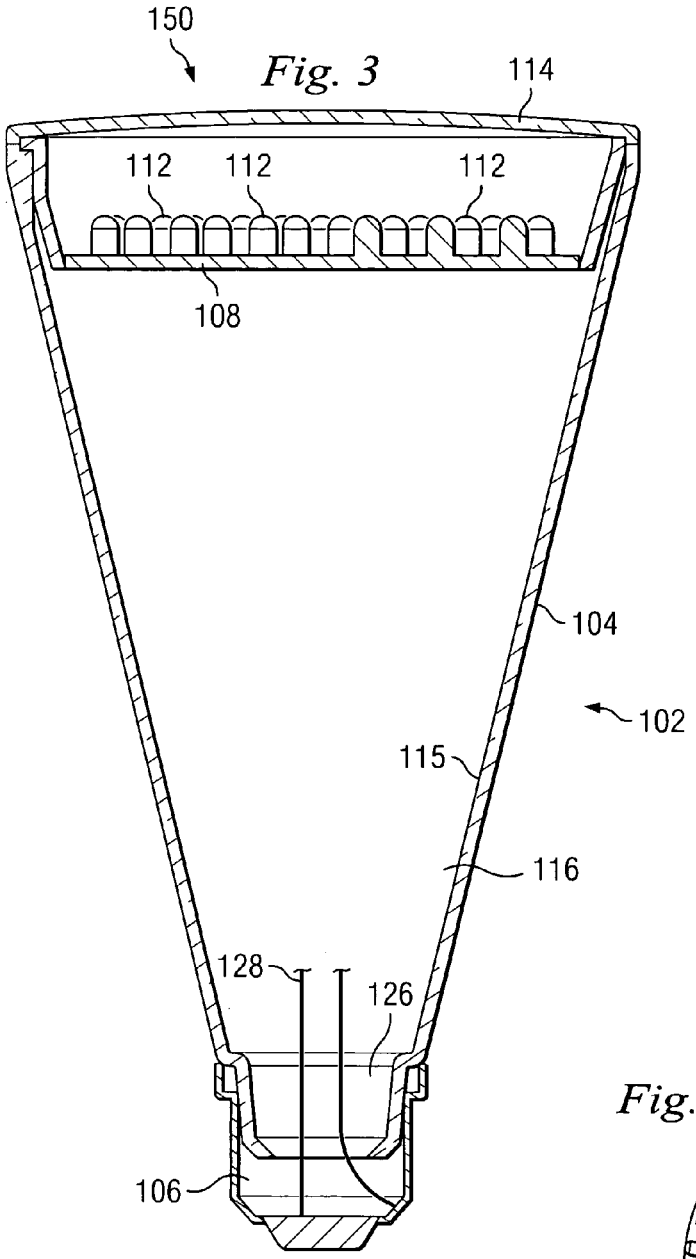
FIG. 3 illustrates a cross-section view of another embodiment of a light bulb having wide angle dispersion material incorporated therein in accordance with the invention.

Referring to FIG. 3 is another embodiment 150 of a light bulb having a wide angle of light dispersion including similar parts as those previously described in FIG. 1, including a housing 102, a side wall 104 having an inside surface 115, a base 106, a substrate 108, a cavity 116, an end cap 114, and a plurality of light emitting elements 112.

Referring to FIGS. 1 and 3, it is important to introduce the crystalline particulate material 124 in the side wall 104 including the inside surface 115 and also the end cap 114 of the present light bulb. Provision is also made so that some light may be introduced beneath the substrate 108 and into the insert cavity 120 and cavity 116. This light will then reflect off of the inside surface 115 and inside surface 122 and back through the substrate 108 and then through the end cap 114. In addition, the support 110 may also comprise a material including particulate matter. In addition, electrical connectors 128 can be routed through the support 110 or through or along the side walls 104 of the housing 102. Electricity supplied to these electrical connectors 128 can be AC or DC, in the case of AC the necessary circuitry 126 may be located in base 106 for converting the AC power to DC power. This circuitry 126 may include resistors, rectifying diodes, and Zener diodes. Rectifying diodes convert AC to DC, should the power source to the LED's be AC. Rectifying diodes are not needed when the power supply is DC.

Figure 4:
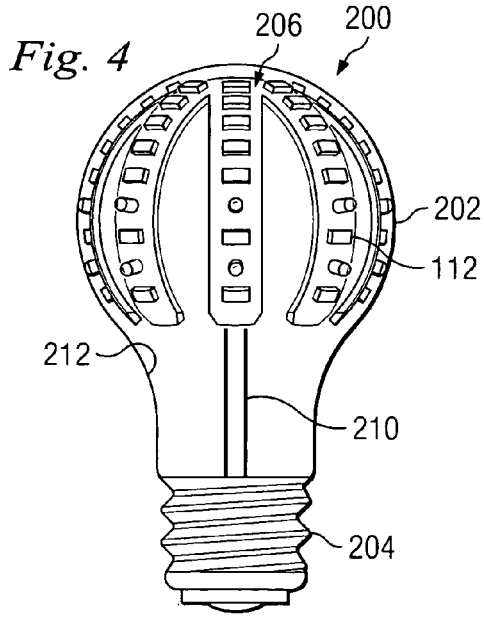
FIG. 4 illustrates a cross-section view of another embodiment of a light bulb having wide angle dispersion material incorporated therein in accordance with the invention.

Referring to FIG. 4, is another embodiment 200 of a light bulb having a wide angle of light dispersion including a housing 202 having an inside surface 212 and a base 204. In this embodiment, a flexible substrate 206 is provided to support a plurality of light emitting elements 112. As can be seen from FIG. 4, the flexible substrate 206 is generally disposed against the inside surface 212. A support 210 can be used to support the flexible substrate 206 in place within the housing 202. As described above, it is important to introduce particulate matter in the housing 202 including the inside surface 212, the support 210, and the flexible substrate 206.

Figure 5:
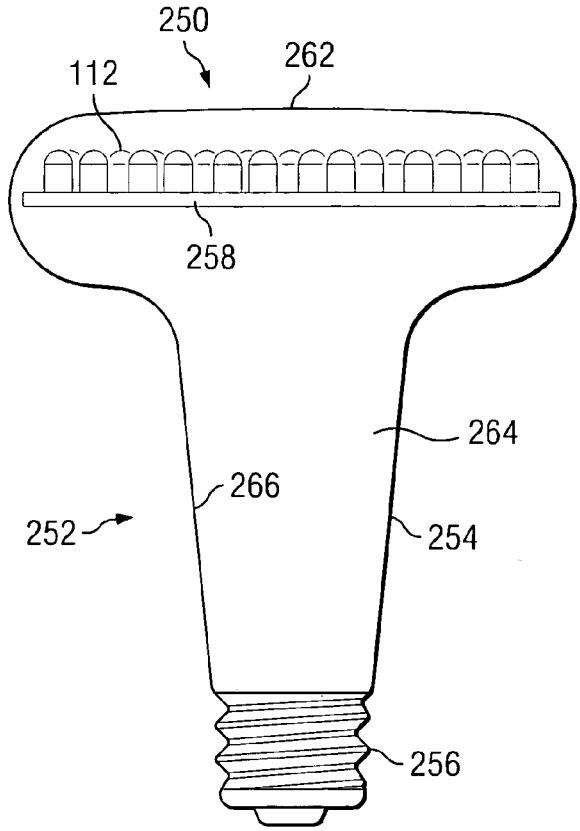
FIG. 5 illustrates a cross-section view of another embodiment of a light bulb having wide angle dispersion material incorporated therein in accordance with the invention.
Figure 6:
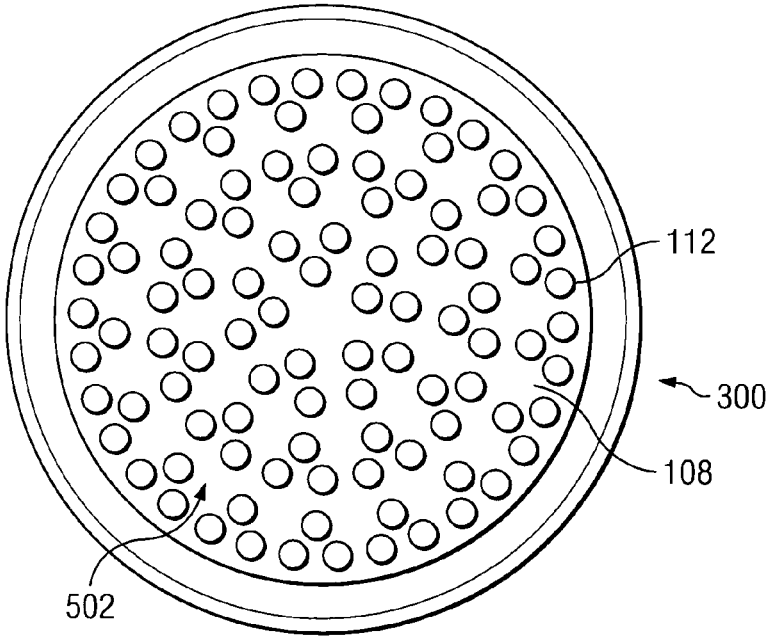
FIG. 6 illustrates a top-section view of a light bulb substrate of the FIGS. 1-3 having wide angle dispersion material incorporated therein in accordance with the invention.
Figure 7:
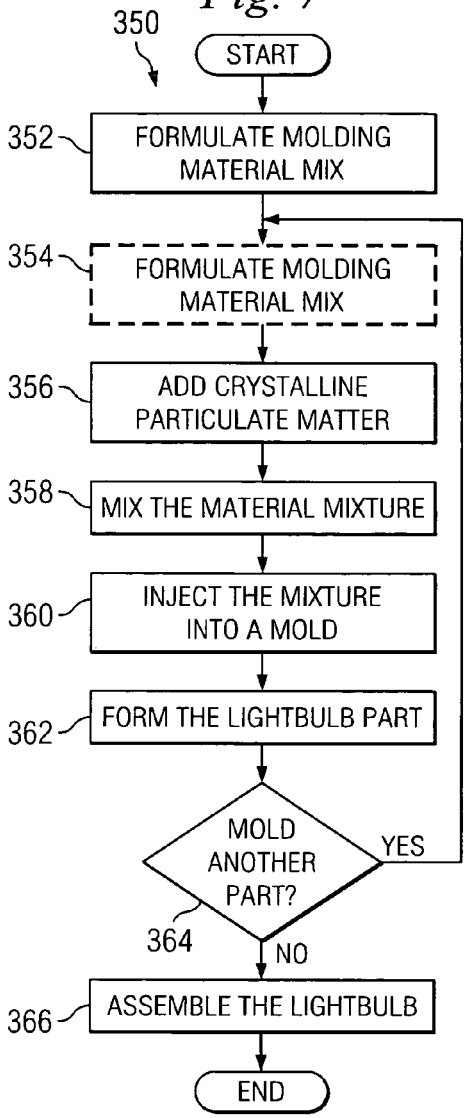
FIGS. 7 and 8 are each a flowchart that shows a process for making a lightbulb.
Figure 8:
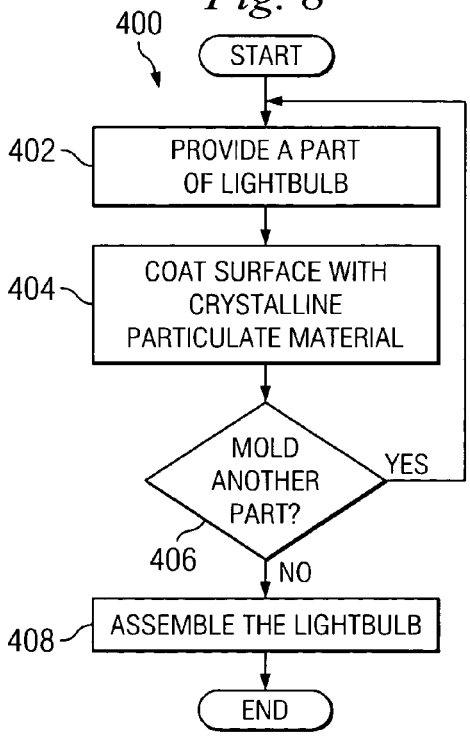

Referring to FIG. 5, is another embodiment 250 of a light bulb having a wide angle of light dispersion including a housing 252 including having a somewhat conically shaped side wall 254 with a flared end having an inside surface 266 and which is provided at one end with a base 256 and a transparent or translucent end cap 262 at the other end. A cavity 264 is defined by the area between the side wall 254 and the end cap 262. Mounted within the cavity 264 of the housing 252 is a substrate 258 having a plurality of light emitting elements 112. Light bulb 250 may further include a support (not shown) located within the cavity 264 for supporting the substrate 258, similar to the support 110 as depicted in FIG. 1. Similarly as describe with reference to the other embodiments of the light bulb, it is important to introduce particulate matter in the side wall 254 including the inside surface 266 and also the end cap 262. Provision is also made so that some light may be introduced beneath the substrate 258. This light will then reflect off inside surface 266 and back through the transparent substrate 258 and then through the end cap 262. In addition, if a support is used with this embodiment, the support may also comprise a material including particulate matter. Referring to FIG. 6, is a top view of an end cap 114, which is similar to the cap 262. As can be seen in FIG. 6, a plurality of light emitting elements 112 are grouped together on substrate 108, which is similar to substrate 258. It is noted that is some arrangements of the light emitting elements 112, gaps 502 can be seen in the substrate 108 where light comes through after being reflected within the cavities 116 and 120.

In one aspect of the present light bulb, the individual parts herein described can be molded or formed individually and then later assembled. In another aspect of the present light bulb, some portions of the light bulbs 100, 150, 200, and 250 can be molded or formed together, while other parts are molded or formed individually and then later assembled. In one aspect of the present light bulbs 100, 150, 200, and 250, the housings 102, 252, and 202, end caps 114, 262, support 110, and substrates 108, 258, and 206 are molded or formed with a mixture of moldable or formable resin including a crystalline particulate material 124.

In one aspect of the present light bulb, end caps 114 and 262, and housing 202 may comprise different shapes, forms, thicknesses, patterns, and etchings to provide further dispersion of the light from the light bulbs 100, 150, 200, and 250.

In the formation of the housings 102, 252, and 202, end caps 114, 262, support 110, and substrates 108, 258, and 206, it is important to use materials that are capable of incorporating a particulate matter during the preparation of the materials prior to forming, molding, or shaping. In another aspect of the present light bulb, it is important to use materials that after being formed are capable of incorporating particulate matter with the use of adhesives or other fixture means. Many resins are known and presently used to form these parts, including glass, plastics, polycarbonates, polymers, copolymers and suitable epoxies and acrylics. In another aspect of the present light bulb, a resin, such as acrylonitrile-butadiene-styrene, is effective for forming some or all of these described parts.

In the formation of the housings 102, 252, and 202, end caps 114, 262, support 110, and substrates 108, 258, and 206, it is important to add the particulate matter to the composition material to be formed or molded preferably in the ranges as aforesaid. A particulate material of very small diameter, such as the diameter or cross-sectional size of dust particles, is added to the resin used in the formation of the housings 102, 252, and 202, end caps 114, 262, support 110, and substrates 108, 258, and 206, and inside surfaces 122, 115, 266 and 212. Preferably, some of the particulate materials include quartz crystals, diamonds, such as industrial grade diamonds, or other symmetrical crystals. Other particulate materials include cubic zirconia, white sapphire and similar dusts in crystalline shape. The particulate matter should have a cross-sectional size no greater than about 1 micron across. However, the size of the particles can vary depending upon the result which is desired.

The amount of crystalline particulate material 124 in the final material blend that is used to manufacture the light bulbs will vary depending upon the desired amount of light dispersion. Obviously, there is a maximum amount of crystalline particulate material 124 which can be added, since an excess of such material could tend to cause some opaqueness. It is preferable to use between 1% to about 12% by weight of particulate material with respect to the resin. However, again this amount could vary depending upon the results which are desired.

It is further preferable to control the orientation of the crystalline particulate material 124 added to the resin material to enhance the wide angle dispersion properties of the light bulbs. At least 60% of the crystalline particulate material 124 should be essentially oriented in the same direction.

It is also possible to perform color blending in the resin-particulate mix. Color can be adjusted by adding a dye only in small amounts so as to avoid interference with the transparency of the material. As a simple example, it is possible to even simulate daylight, such as sunlight, by introducing a small amount of a yellow dye into the resin-particulate mixture.

It is, again, preferred to use crystalline particulate material 124 comprised of symmetrical crystals since they provide the highest degree of reflectivity and at a variety of angles. The variation of the angles of the particulate matter increases the wide angle dispersion qualities of the light bulbs 100, 150, 200, and 250. It may even be desirable to provide a slight coating of these ground crystals on the interior surface of the end caps 114, 262 and housing 202 to provide an even greater degree of dispersion.

Light emitting elements 112 include but are not limited to light emitting diodes (LED's), and they may be other types of diode lights, such as laser diodes and wide band gap LED's. Generally, these typical LED's are normally constructed using standard AlInGaN or AlInGaP processes and include a LED chip or die mounted to a reflective metal dish or reflector that is generally filled with a transparent or semi-transparent epoxy, thus encapsulating the LED chip. Any color of LED's can be used with the present LED light bulb, colored LED's such as red (R), blue (B), green (G) or amber (A) can be used in addition to white (W) with the present LED light bulb to accommodate the desired application.

Although there has been described what is at present considered to be the preferred embodiments of the present light bulb, it will be understood that the invention can be embodied in other specific forms without departing from the spirit or essential characteristics thereof. For example, the shape of the light bulb may be different than those described herein and still embody the present light bulb. Furthermore, the light source could be other types of light sources than those described herein and still embody the present light bulb. The present embodiments are, therefore, to be considered in all aspects as illustrative and not restrictive. The scope of the invention is indicated by the appended claims rather than the foregoing description.

What is claimed:

1. A light bulb generating an output comprising electromagnetic emissions in the visible wavelength range to produce a widely dispersed light, comprising:

a housing having a base and an optical opening for emitting said widely dispersed light from said housing;

an optical element positioned substantially over said optical opening;

a source of lighting located within said housing; and electrical leads connecting said base with said source of lighting, wherein said housing and said optical element each have structure that causes wide dispersion of light traveling from said source of lighting to said optical opening, said structure including a mixture of moldable material and transparent particulate crystalline material.

2. The light bulb having widely dispersed light of claim 1 wherein said optical element is composed of a substantially translucent material.

3. The light bulb having widely dispersed light of claim 1 wherein said transparent particulate crystalline material is substantially symmetrical.

4. The light bulb having widely dispersed light of claim 1 wherein said transparent particulate crystalline material is selected from the group consisting of quartz crystals, diamond crystals, sapphire crystals, and zirconia crystals.

5. The light bulb having widely dispersed light of claim 1 wherein said transparent particulate crystalline material is present in said mixture from about 1 to 12 percent by weight, based on the total mixture composition.

6. The light bulb having widely dispersed light of claim 1 wherein said transparent particulate crystalline material has planes that are oriented in substantially the same direction.

7. The light bulb having widely dispersed light of claim 1 wherein said housing is substantially conically-shaped.

8. The light bulb having widely dispersed light of claim 1 wherein said moldable material is selected from the group consisting of polymers, copolymers, epoxies, acrylics, polyester resins, and resins.

9. The light bulb having widely dispersed light of claim 1 wherein at least a portion of said optical element comprises a colored material.

10. The light bulb having widely dispersed light of claim 1 wherein said source of lighting is at least one light emitting diode.

11. The light bulb having widely dispersed light of claim 1 wherein said source of lighting further comprises a substrate for accepting at least one light emitting diode.

12. The light bulb having widely dispersed light of claim 11 wherein said substrate is a flexible substrate capable of forming substantially to the inside surface of said housing.

13. The light bulb having widely dispersed light of claim 1 further comprising:

a source of light emitting electromagnetic light in the non-visible wavelength range.

* * * * *